United States Patent [19]

Wang et al.

[11] Patent Number: 4,747,798

[45] Date of Patent: May 31, 1988

[54] FLYING DISH

[76] Inventors: Te-Cheng Wang, No. 2-1, Alley 3, Lane 53, Nanking E. Rd., Sec. 4; Wen-Tang Liu, No. 2, Alley 8, Lane 62, Hsi-Tsang Rd., both of Taipei; Ke-Chang Lu, 9F.-3, No. 154, Kuan-Chien W. Rd., Pan-Chiao City, Taipei, all of Taiwan

[21] Appl. No.: 18,540

[22] Filed: Feb. 25, 1987

[51] Int. Cl.[4] ..... A63H 27/00

[52] U.S. Cl. ..... 446/47

[58] Field of Search ..... 446/47, 46, 48; 273/424, 425, 428; D21/86, 85

[56] References Cited

U.S. PATENT DOCUMENTS 4,246,720 1/1981 Stone ..... 446/47

*Primary Examiner*—Mickey Yu

*Attorney, Agent, or Firm*—Ostrolenk, Faber, Gerb & Soffen

[57] ABSTRACT

A flying dish having a convex center portion surrounded by a concave ring portion. The convex center portion has the form of the pistils of a flower. The concave ring portion supports petals of a flower. The concave ring portion contains respective pivot axles for the flower petals. Each pivot axle is provided with a coiled spring extending between the inner wall of the concave ring portion and a slot on the back of a flower petal. Each flower petal is provided with a small whistle. When the rotational speed of the flying dish reaches a predetermined level, the flower petals open under centrifugal force and begin whistling due to the air stream. When the speed of the flying dish slows, the flower petals gradually close and the whistling disappears.

11 Claims, 1 Drawing Sheet

A-A SECTION

FIG. 1
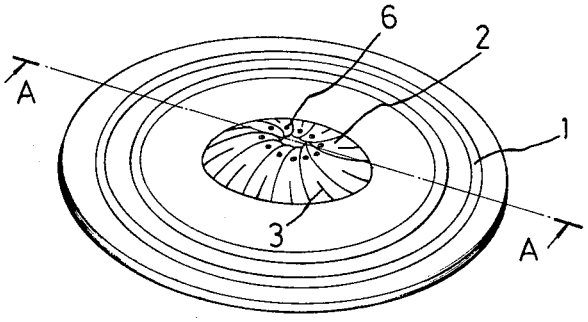
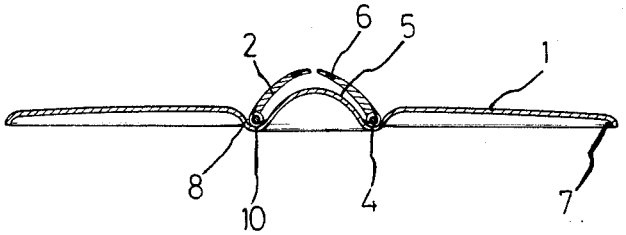
A-A SECTION
FIG. 2
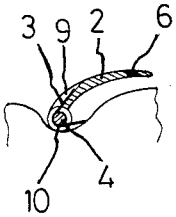
FIG. 3
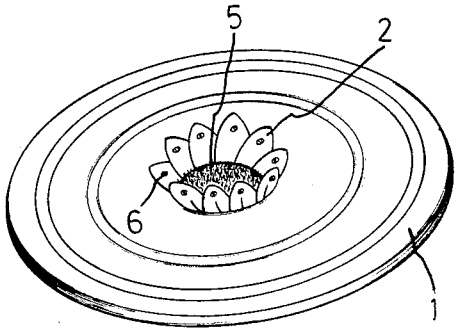
FIG. 4

FLYING DISH

FIELD OF THE INVENTION

The invention relates to a flying dish, especially a flying dish having petals which open and produce different whistling sounds at high flying speeds to please beginners or children and to promote their learning interest in addition to serving a physical exercise purpose.

BACKGROUND OF THE INVENTION

The appearance of the traditional flying dish is simple and clumsy. The players enjoy playing with it because, once the players master its playing skill, they can control the flying styles of a flying dish. But this playing skill can only be obtained by long time practice. Beginners or children will lose interest because they cannot acquire this playing skill in a short time.

OBJECTS OF THE INVENTION

The objects of the invention are to resolve the foregoing shortcomings and to provide a new flying dish. With this new flying dish much fun can be obtained by beginners or children when they throw it out or catch it by hand. Interest in physical exercise is promoted. For skilled players, more playing variations can thus be obtained.

SUMMARY OF THE INVENTION

The present invention contemplates a new flying dish. One of its features is the provision at the central part of the disk cover of closed flower petals. Each flower petal is provided with a small whistle. When this flying dish is thrown out, the flower petals of this flying dish will be opened by centrifugal force and rise up, thereby making this flying dish just like a blooming flower. At the same time, each petal produces a different whistling sound by its passage through the air. When the flying speed of this flying dish is reduced to a certain level, the petals will close again and no more whistling sound will be produced. Through this device, the wonder, interest, and beautification purposes of a flying dish are served.

BRIEF DESCRIPTION OF THE DRAWINGS

FIG. 1 is a view in perspective of a flying dish made in accordance with the present invention.

FIG. 2 is a cross-sectional view taken at line A—A of FIG. 1.

FIG. 3 shows the enlarged view of a petal portion of FIG. 2.

FIG. 4 is a view in perspective of a flying dish during flight, on which the flower petals are opened.

SPECIFIC DESCRIPTION

Referring to FIGS. 1 and 2, the invention comprises: a dish body 1, elements looking like flower petals 2, coiled springs 3, pivot axles 4, pistils 5, and whistles 6. The dish body is formed into a circular shape with a periphery bent downwardly 90° to form its outer edge 7 (FIG. 2) to facilitate throwing out or catching. The center part of the dish body 1 is provided with a convex portion which simulates the pistils 5 of a flower. Around this convex portion, it is provided with a concave or depressed ring portion 8 for the installations of the petals 2 of a flower. The wall of the concave ring portion is provided with a plurality of pivot axes. The number of these pivot axles 4 is equal to the number of flower petals 2. Each flower petal 2 is pivoted to a pivot axle 4.

Each pivot axle 4 is provided with a coiled spring 3 around it. One leg of the coiled spring 3 is rested on the inner wall of the concave ring portion 8, the other leg of the coiled spring 3 is pressed against a slot defined on the back of a flower petal 2. The purpose of this arrangement is to keep the flower petals in closed condition of FIG. 1 when the flying dish is stationary or flies at a slow flying speed. Each spring 3 also inherently joins the pivot axle 4 about which it is wound both to the inner wall of the ring portion 8 and to the respective petal 2.

The flower petals 2 are made of thin sheet material and they are formed into the petal shape of a selected flower. The rear end of each petal is provided on a respective pivot axle 4. On the back side at center line of each petal there is also provided a slot 9. One leg of the coiled spring 3 is pressed against this slot 9 to cause each petal 2 to stay in closed condition.

The front side of each petal 2 is provided with a whistle 6 of a different frequency. Therefore, when the flower petals are opened by centrifugal force when the flying dish flies, the air stream blows these whistles to produce different whistling sounds.

As shown in FIG. 3, when the dish is rotating on flight, centrifugal force pulls the petals 2 open against the spring force of each coiled spring 3 and makes the flying dish appear to be a flying blooming flower. Also at the same time, the whistles 6 produce different whistling sounds.

When the speed of the flying dish is reduced to the extent that the spring force of each coiled spring 3 is greater than the centrifugal force, then, the petals 2 will be pressed to close and no more whistling sound will be produced.

We claim:

1. A flying dish adapted to fly through the air, said dish having:
   - a center; an annular area surrounding said center located on one surface of said dish;
   - a plurality of petals pivotally mounted to said dish at said annular area; each said petal being pivotable between lying down over said dish surface at said center of said dish and being upraised off said center of said dish.

2. The flying dish of claim 1, further comprising a respective axle for each said petal at said area; each said petal being supported on and pivotable about its axle.

3. The flying dish of claim 1, further comprising means for normally biasing each said petal to lie down over said center and for permitting said petal to be upraised upon centrifugal force being sufficient.

4. The flying dish of claim 1, further comprising whistle devices carried on said petals, said whistle devices being activated by the passage of said petals through the air.

5. The flying dish of claim 1, wherein said center of said dish is shaped to simulate the pistils of a selected plant and the petals to simulate the petals of the same plant.

6. The flying dish of claim 1, wherein said center is convex in shape with respect to said petals.

7. The flying dish of claim 6, wherein said annular area is concave in shape with respect to said petals.

8. The flying dish of claim 1, wherein said annular area is concave in shape with respect to said petals.

9. The flying dish of claim 2, wherein said annular area is concave in shape with respect to said petals and said axles in said concave area.

10. The flying dish of claim 7, wherein said center is shaped to simulate the pistils of a selected plant and the petals to simulate the petals of the same plant.

11. The flying dish of claim 3, further comprising a respective axle for each said petal at said area; each said petal being supported on and pivotable about its axles;

said annular area is concave in shape with respect to said petals;

said means for biasing said petals comprise coil springs at each said axle extending between said dish at said concave area and the respective said petal closed to cover said center.

* * * * *